US010829326B2

(12) United States Patent
Matsui

(10) Patent No.: US 10,829,326 B2
(45) Date of Patent: Nov. 10, 2020

(54) SHEET FEEDER, METHOD FOR CONTROLLING SHEET FEEDER

(71) Applicant: KYOCERA Document Solutions Inc., Osaka (JP)

(72) Inventor: Shinya Matsui, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/795,260

(22) Filed: Feb. 19, 2020

(65) Prior Publication Data

US 2020/0299089 A1 Sep. 24, 2020

(30) Foreign Application Priority Data

Mar. 22, 2019 (JP) ..... 2019-054807

(51) Int. Cl.
*B65H 3/12* (2006.01)
*B65H 7/16* (2006.01)
*B65H 7/12* (2006.01)

(52) U.S. Cl.
CPC ..... *B65H 7/16* (2013.01); *B65H 3/128* (2013.01); *B65H 7/12* (2013.01); *B65H 2301/3115* (2013.01); *B65H 2301/35* (2013.01); *B65H 2404/231* (2013.01); *B65H 2511/25* (2013.01); *B65H 2515/212* (2013.01); *B65H 2515/342* (2013.01)

(58) Field of Classification Search
CPC ..... B65H 3/047; B65H 3/08; B65H 3/0816; B65H 3/0808; B65H 3/0841; B65H 3/12; B65H 3/124; B65H 3/128
USPC ..... 271/94, 96, 97, 98
See application file for complete search history.

(56) References Cited

U.S. PATENT DOCUMENTS 5,110,110 A * 5/1992 Wirz ..... B65H 3/48 239/587.1
5,988,626 A * 11/1999 La Vos ..... B65H 3/128 271/96
9,096,399 B2 * 8/2015 Umemoto ..... B65H 3/128
2015/0021848 A1 * 1/2015 Mizuno ..... B65H 7/16 271/12

FOREIGN PATENT DOCUMENTS

JP 2015-16954 A 1/2015

* cited by examiner

*Primary Examiner* — Thomas A Morrison
(74) *Attorney, Agent, or Firm* — Stein IP, LLC

(57) ABSTRACT

A suction fan of a sheet feeder sucks in air through a sheet feeding belt to generate flotation air. The suction fan uses the flotation air to attract set sheets by suction. A belt motor rotates a sheet feeding belt and feeds out a sheet of the set sheets. An interval measurer measures a sheet-to-sheet interval when the suction fan is attracting the sheet by suction. Based on an output of the interval measurer, a controller recognizes the sheet-to-sheet interval. Based on the recognized sheet-to-sheet interval, the controller adjusts a flow rate of the flotation air.

7 Claims, 7 Drawing Sheets

SHEET FEEDER, METHOD FOR CONTROLLING SHEET FEEDER

This application is based upon and claims the benefit of priority from the corresponding Japanese Patent Application No. 2019-054807 filed on Mar. 22, 2019, the entire contents of which are incorporated herein by reference.

BACKGROUND

The present disclosure relates to a sheet feeder that feeds a set sheet by attracting the sheet by suction and to a method for controlling the same. The present disclosure also relates to an image forming apparatus including such a sheet feeder.

There are sheet feeders that employ an air system. Some of the air-system sheet feeders include a conveyance belt. The conveyance belt attracts a sheet thereto by suction. The sheet is made to adhere to the conveyance belt by suction. In this state, the conveyance belt is driven. As a result, the sheet is fed out. Described below is a known example of the air-system sheet feeders.

Specifically described is a sheet feeder that includes an endless conveyance belt that has a plurality of suction holes and that conveys a sheet adhered thereto by suction, an air suction portion which is provided inside the conveyance belt and which attracts a sheet by suction to make the sheet adhere to the conveyance belt, a flotation air blowing portion which blows flotation air to a sheet accommodated in a sheet storage portion to float the sheet, a sheet rear edge detection portion which is arranged at a predetermined position within a range of a conveyance surface of the conveyance belt in the sheet conveyance direction and which detects the rear edge of the first sheet passing the predetermined position, and a control portion which controls flotation air blowing operation performed by the flotation air blowing portion. Here, while a first sheet is being conveyed by the conveyance belt, the flotation air is blown to float a second sheet, and the blowing of the flotation air is stopped based on a result of detection performed by the sheet rear edge detection portion. This sheet feeder is designed to prevent multi-feeding where the second sheet is made to adhere to the conveyance belt by suction when the first sheet is being conveyed.

Multi-feeding occasionally occurs in a feeding device. In multi-feeding, a plurality of sheets are conveyed in a state of being stuck together. Multi-feeding can result in sheet jamming (jam). Multi-feeding can also result in erroneous printing in which an image to be printed in one page is printed over a plurality of sheets. Thus, multi-feeding can cause errors.

Multi-feeding is caused by various factors in an air-system sheet feeder. In an air-system sheet feeder, a flow rate is determined based on each type of sheet (standard sheet) recommended by the manufacturer of the image forming apparatus. However, there are a large number of types of sheets. There are cases where the flow rate determined based on a standard sheet is inadequate for some other types of sheets. There is a risk of multi-feeding in such cases. Possible factors of multi-feeding also include the sheet moisture content, the sheet surface coarseness, the aging deterioration of the performance of a fan for manipulating air, and clogging of a blowing portion with dust. The likelihood of multi-feeding depends on the type of the sheet, the state of the feeding device, etc., and unfortunately, there are cases where multi-feeding is inevitable.

According to the known technique described above, the blowing of the flotation air is stopped when the rear edge of the first sheet passes the predetermined position. The technique is designed to prevent the second sheet from being attracted by suction to adhere to the conveyance belt while the first sheet is being conveyed; however, multi-feeding can occur depending on the type of a sheet, the state of the sheet feeder, etc. For example, when light (thin) sheets are used, there can be a case where first and second sheets are attracted by suction to adhere to the conveyance belt in a state of overlapping each other. Thus, the known technique discussed above is insufficient to solve the problems described above.

SUMMARY

According to an aspect of the present disclosure, a sheet feeder includes a sheet setting plate, a regulation cursor, a sheet feeding belt, a suction fan, a belt motor, an interval measurer, and a controller. On the sheet setting plate, sheets are set. The regulation cursor regulates positions of the sheets set on the sheet setting plate. The sheet feeding belt is provided above the sheet setting plate and the sheets set on the sheet setting plate. The sheet feeding belt is provided with a suction hole. The suction fan sucks in air through the sheet feeding belt to generate flotation air. The suction fan uses the flotation air to attract by suction the sheets set on the sheet setting plate. The belt motor rotates the sheet feeding belt to feed out a sheet of the sheets set on the sheet setting plate. The interval measurer measures a sheet-to-sheet interval when the suction fan is attracting the sheet by suction. The controller recognizes the sheet-to-sheet interval based on an output of the interval measurer. The controller adjusts a flow rate of the flotation air based on the sheet-to-sheet interval recognized.

According to another aspect of the present disclosure, a method for controlling a sheet feeder includes setting sheets on a sheet setting plate, regulating positions of the sheets set on the sheet setting plate by using a regulation cursor, providing a sheet feeding belt provided with a suction hole above the sheet setting plate and the sheets set on the sheet setting plate, sucking in air through the sheet feeding belt to generate flotation air, using the flotation air to attract by suction the sheets set on the sheet setting plate, rotating the sheet feeding belt to feed out a sheet of the sheets set on the sheet setting plate, measuring a sheet-to-sheet interval when the sheet is being attracted by suction, and recognizing the sheet-to-sheet interval to adjust a flow rate of the flotation air based on the sheet-to-sheet interval recognized.

Further features and advantages of the present invention will become apparent from the description of embodiments given below.

DETAILED DESCRIPTION

According to the present disclosure, the flow rate of air for feeding a sheet is adjusted such that no problem (multi-feeding) will occur regardless of the type of the sheet, the usage years (hours) of the sheet feeder, etc. Now, a description will be given of a sheet feeder according to an embodiment of the present disclosure, with reference to FIG. 1 to FIG. 7. The description will deal with a printer 100 as an example of the sheet feeder. The printer 100 operates also as an image forming apparatus. It should be noted that the present disclosure is applicable not only to the printer 100 but also to any other devices (for example, multifunction peripherals) that perform sheet feeding. Factors such as configurations and arrangements described below are merely illustrative examples, and are not to be construed as limiting the present disclosure.

Figure 1:
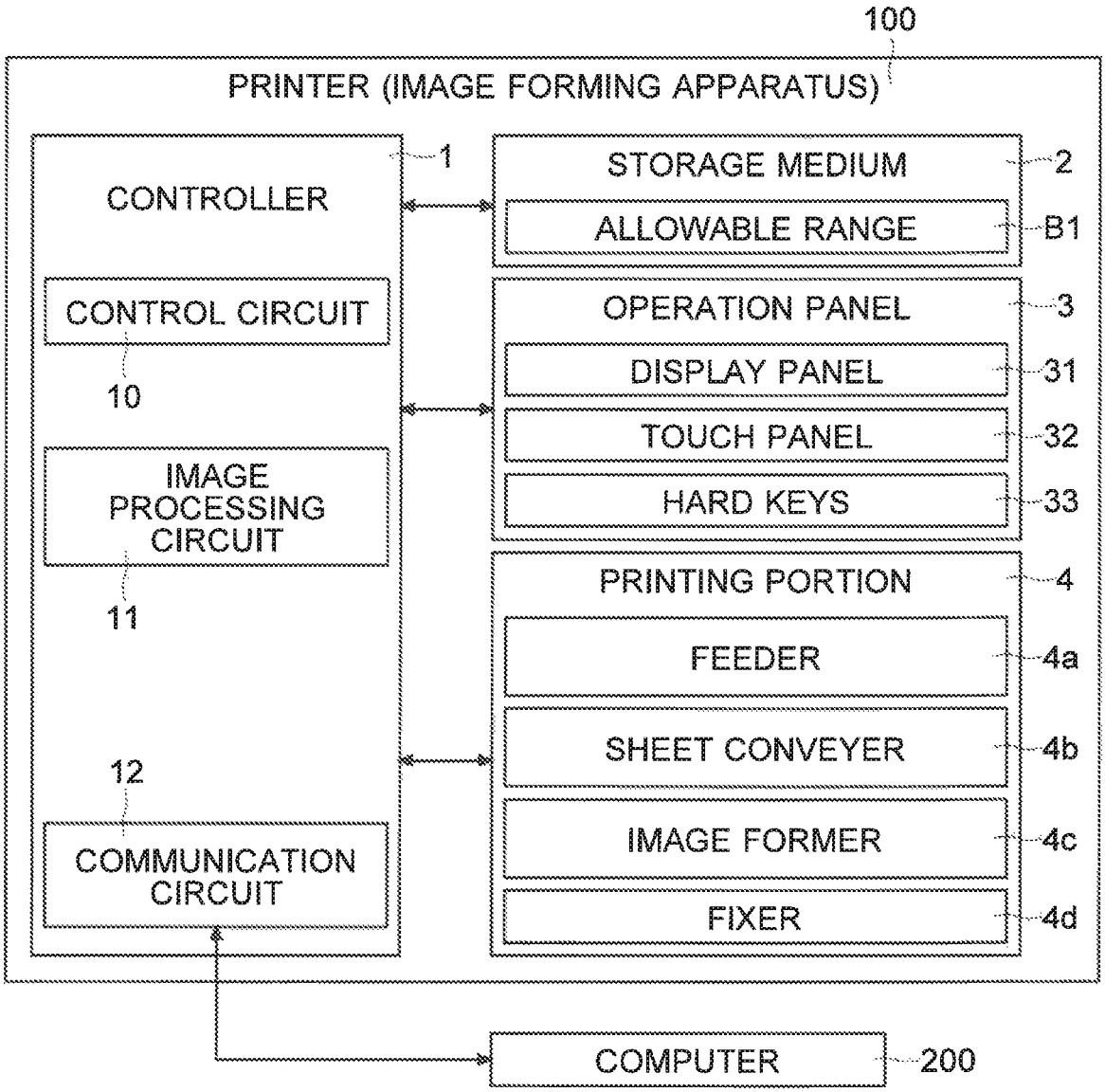
FIG. 1 is a diagram showing an example of a printer according to an embodiment.

Printer 100:

With reference to FIG. 1, a description will be given of the printer 100 according to the embodiment. As shown in FIG. 1, the printer 100 includes a controller 1 (a control board), a storage medium 2, an operation panel 3, and a printing portion 4. The controller 1 controls operation of the printer 100. The controller 1 controls operation in jobs such as copying, transmission, etc. The controller 1 includes a control circuit 10, an image processing circuit 11, and a communication circuit 12. For example, the control circuit 10 is a CPU. The control circuit 10 performs processing and calculation for the jobs.

For example, the image processing circuit 11 is an ASIC. Based on print data that the communication circuit 12 receives, the image processing circuit 11 generates image data. The image processing circuit 11 performs image processing on the generated image data to generate output image data. The output image data is used in a print job.

The communication circuit 12 includes a communication control circuit and a communication memory. The communication memory stores communication software therein. The communication circuit 12 communicates with a computer 200. For example, the computer 200 is a personal computer or a server. The communication circuit 12 receives the print data from the computer 200. For example, the print data includes data described in a page description language. The controller 1 (the image processing circuit 11) analyzes the data described in the page description language, and generates the image data. Based on the image data generated, the controller 1 makes the printing portion 4 perform printing.

The printer 100 includes, as the storage medium 2, a RAM, a ROM, and a storage.

The storage is, for example, an HDD or an SSD. The controller 1 controls the components based on programs and data stored in the storage medium 2.

The operation panel 3 accepts a setting made by a user. The operation panel 3 includes a display panel 31, a touch panel 32, and hard keys 33. The controller 1 makes the display panel 31 display a message, a setting screen, etc. The controller 1 makes the display panel 31 display operation images. For example, the operation images include buttons, keys, and tabs. The controller 1 recognizes, based on an output of the touch panel 32, which operation image has been operated. The hard keys 33 include a start key, a numeric key pad, etc. The touch panel 32, and the hard keys 33 accept setting operation (operation for a job) performed by the user. For example, the operation panel 3 accepts a setting for document reading. For example, the operation panel 3 accepts a setting of the size of a document to be read. The controller 1, based on the output of the operation panel 3, recognizes what has been set.

The printing portion 4 includes a feeder 4*a* (of which details will be given later), a sheet conveyer 4*b*, an image former 4*c*, and a fixer 4*d*. In a print job, the controller 1 makes the feeder 4*a* feed a sheet. The sheet conveyer 4*b* includes conveyance roller pairs and a conveyance motor for conveying a sheet. The conveyance roller pairs convey a sheet. The conveyance motor rotates the conveyance roller pairs. The controller 1 makes the sheet conveyer 4*b* convey a sheet.

The Image former 4*c* includes, for example, a photosensitive drum, a charging device, an exposure device, a developing device, and a transfer roller. Based on the output image data, the controller 1 makes the image former 4*c* form a toner image. The controller 1 makes the image former 4*c* transfer the toner image to the sheet conveyed thereto. The fixer 4*d* includes a heater, a fixing roller, and a fixing motor. The heater heats the fixing roller. The sheet is conveyed while being in contact with the fixing roller. Thereby, the toner image is fixed on the sheet. The controller 1 makes the fixer 4*d* fix the transferred toner image onto the sheet. The sheet conveyer 4*b* discharges the printed sheet to outside the apparatus.

Sheet Feeding Cassette 5:

Next, with reference to FIG. 2 to FIG. 5, a description will be given of an example of a sheet feeding cassette 5 according to the embodiment. The sheet feeder includes the sheet feeding cassette 5. The sheet feeding cassette 5 is can be pulled out form the printer 100. The sheet feeding cassette 5 is pulled out (opened) to replenish sheets into it. After the sheet replenishment, the sheet feeding cassette 5 is pushed back into the printer 100.

Figure 2:
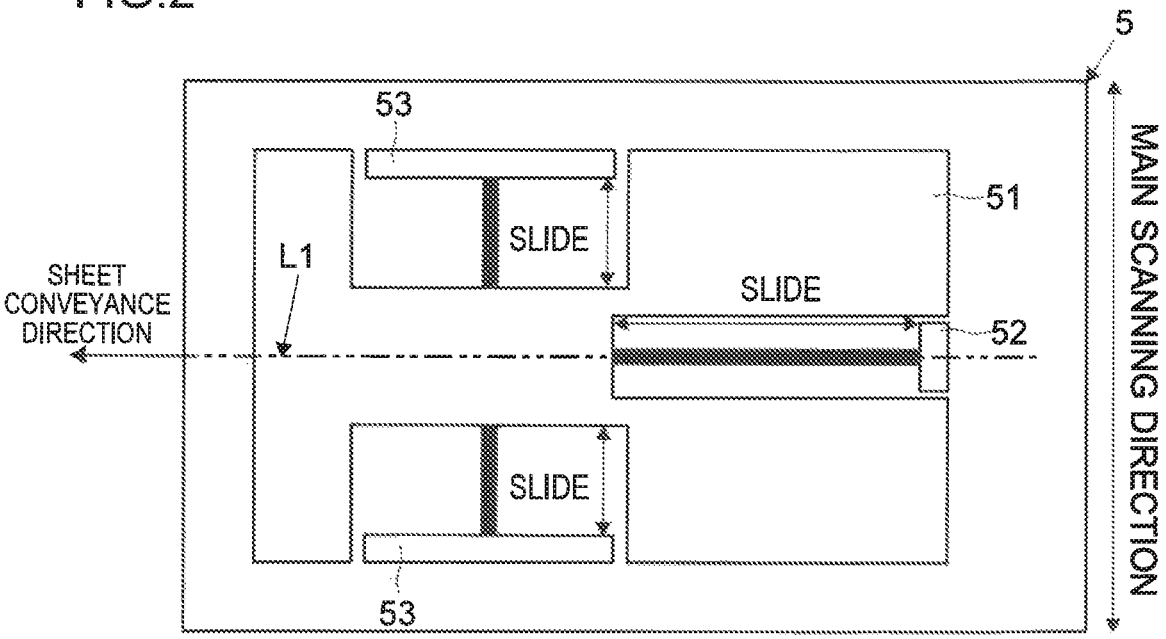
FIG. 2 is a diagram showing an example of a sheet feeding cassette according to the embodiment.

FIG. 2 is a diagram showing the sheet feeding cassette 5 as seen from above. As shown in FIG. 2, the sheet feeding cassette 5 includes a sheet setting plate 51 and a regulation cursor. The sheet setting plate 51 is, for example, a metal plate. On the sheet setting plate 51, sheets (a stack of sheets) are set. The sheets are set to be laid one on another in an up-down direction. FIG. 2 shows the sheet setting plate 51 having no sheet set thereon.

The regulation cursor regulates the positions of the sheets set on the sheet setting plate 51. The sheet feeding cassette 5 is provided with, as the regulation cursor, a rear edge regulation cursor 52 and a width regulation cursor 53. Of the sheet setting plate 51, such part as overlaps with the rear edge regulation cursor 52 or the width regulation cursor 53 is cut off.

The rear edge regulation cursor 52 regulates the positions of the rear edges of the set sheets. The rear edges of the set sheets are their upstream-side edges in the sheet conveyance direction (the sub scanning direction). The rear edge regulation cursor 52 is slidable in the sheet conveyance direction. The user moves the rear edge regulation cursor 52 until it comes into contact with the rear edges of the set sheets. By the contact of the rear edge regulation cursor 52 with the rear edges, the positions of the set sheets are regulated. This helps prevent the sheets from becoming misaligned with each other.

The width regulation cursor 53 regulates the set sheets in a direction perpendicular to the sheet conveyance direction (a main scanning direction). The width regulation cursor 53 is composed of two width regulation cursors 53 functioning as a pair. Each of the width regulation cursors 53 is slidable in a direction perpendicular to the sheet conveyance direction. The width regulation cursors 53 slide interlocking with each other. When one width regulation cursor 53 is moved toward the center of the sheet in the main scanning direction, the other width regulation cursor 53 also moves toward the center. When one width regulation cursor 53 is moved in a direction away from the center of the sheet in the main scanning direction, the other width regulation cursor 53 also moves in a direction away from the center. The width regulation cursors 53 move by the same amount.

The user moves the width regulation cursors 53 until they come into contact with edges of the set sheets. By the width regulation cursors 53 coming into contact with the edges, the positions of the sheets in the main scanning direction are regulated. This helps prevent the sheets from becoming misaligned with each other in the main scanning direction. The two-dot chain line in FIG. 2 indicates a center line L1. The center line L1 indicates the center of a conveyance path and the centers of the sheets in the main scanning direction. The width regulation cursors 53 regulate the positions of the sheets such that the centers of the sheets in the main scanning direction coincide with the center line L1 (centered sheet feeding).

Figure 3:
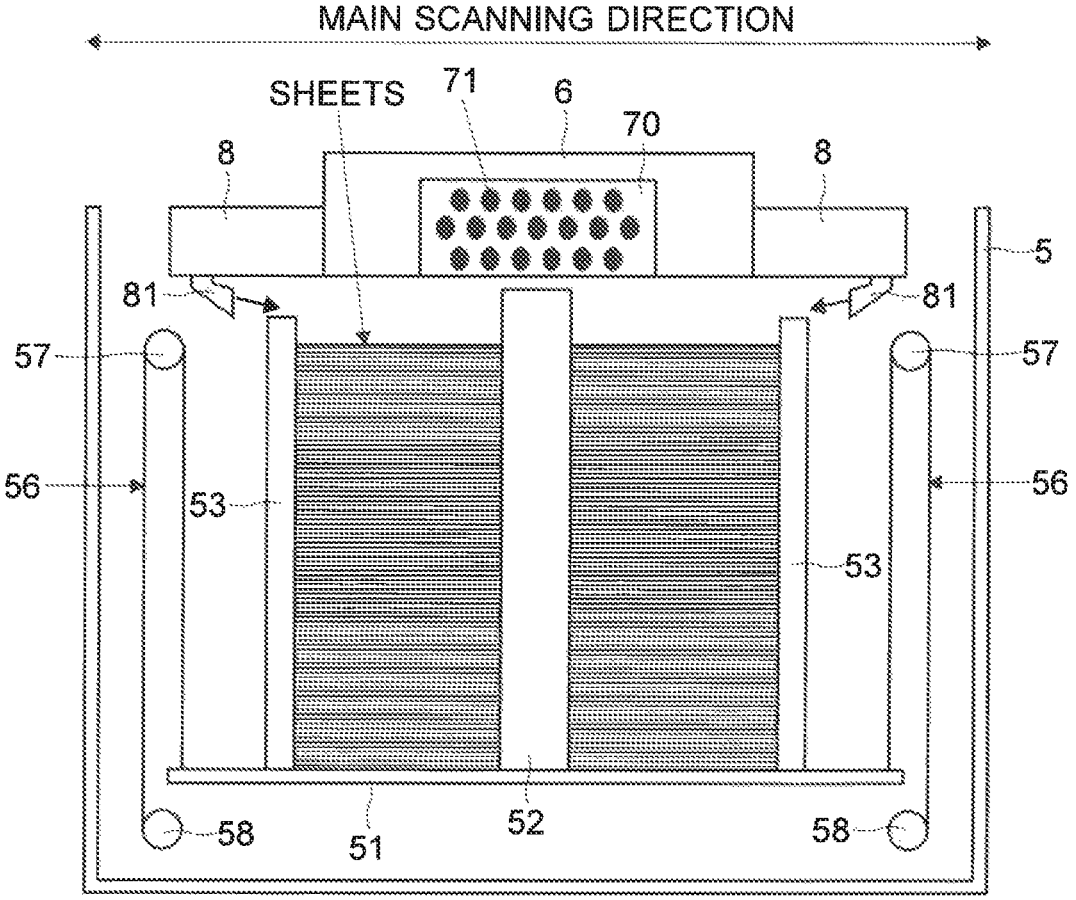
FIG. 3 is a diagram showing the example of the sheet feeding cassette according to the embodiment.

FIG. 3 is an example of a diagram that shows sheets as seen from the sheet rear edge side (the upstream side in the sheet width direction). As shown in FIG. 3, above a top sheet of the sheets set (stacked) and the sheet setting plate 51, a sheet feeding belt 70 and an air-blowing separation device 8 are provided.

The sheet feeding cassette 5 (the sheet feeder) is provided with an elevator mechanism 54. The elevator mechanism 54 moves the sheet setting plate 51 up and down. The elevator mechanism 54 includes a plurality of pulley mechanism and an elevator motor 55, for example. Each pulley mechanism includes a wire 56, a pulley 57, and a take-up drum 58. One end of the wire 56 is fitted to an end part of the sheet setting plate 51. The other end of the wire 56 is connected to the take-up drum 58. Around the pulley 57, the wire 56 is wound. The elevator motor 55 rotates the take-up drum 58. To raise the sheet setting plate 51, the controller 1 rotates the elevator motor 55 in a direction for raising the sheet setting plate 51 (in other words, in a direction for making the take-up drum 58 take up the wire 56). To lower the sheet setting plate 51, the controller 1 rotates the elevator motor 55 in a direction for lowering the sheet setting plate 51 (in other words, in a direction for reducing the amount of wire 56 taken up by the take-up drum 58).

FIG. 3 shows an example provided with two pulley mechanisms. Instead, more than two pulley mechanisms may be provided. For example, one pulley mechanism may be provided at each of the four corners of the sheet setting plate 51. Or, the elevator mechanism 54 may raise and lower the sheet setting plate 51 by another technique, without using pulleys.

During sheet feeding, the controller 1 maintains the position of a top sheet of the stack of sheets to a specified position (specified height). The specified position of a top sheet is defined as a position at which the interval between the sheet feeding belt 70 and the top sheet in the up-down direction is a predetermined sheet feeding interval. The sheet feeding interval is any distance in a range from several millimeters to several centimeters (for example, 1 cm).

Inside the sheet feeding cassette 5, a sheet position sensor 59 is provided. The sheet position sensor 59 is a sensor for sensing that the top sheet is located at the specified position. For example, a reflection type or transmission type optical sensor can be used as the sheet position sensor 59. When the sheet setting plate 51 is raised and a top sheet reaches the specified position, the output level of the sheet position sensor 59 changes. Also, when the position (height) of a top sheet falls below the specified position, the output level of the sheet position sensor 59 changes. The output of the sheet position sensor 59 is fed to the controller 1.

When raising the sheet setting plate 51, the controller 1 monitors the output level of the sheet position sensor 59. On recognizing that a top sheet has reached the specified position based on a change of the output level of the sheet position sensor 59, the controller 1 stops raising the sheet setting plate 51. On recognizing that the position of a top sheet has fallen below the specified position during a print job (continuous sheet feeding) based on a change of the output level of the sheet position sensor 59, the controller 1 rotates the elevator motor 55. The controller 1 continues to rotate the elevator motor 55 until it recognizes that the top sheet has reached the specified position. The controller 1 maintains the position of a top sheet in the up-down direction at the specified position (the specified height).

Now, with reference to FIG. 3 to FIG. 5, a suction device 6 and a feeding out mechanism 7 will be described. As shown in FIG. 3, the suction device 6 and the feeding out mechanism 7 are provided above the sheet setting plate 51, the set stack of sheets, the width regulation cursors 53, and the rear edge regulation cursor 52.

The feeding out mechanism 7 includes the sheet feeding belt 70, a drive roller 72, a plurality of driven rollers 73, and a belt motor 74. A plurality of suction holes 71 are provided in the sheet feeding belt 70. FIG. 3 shows an example where the suction holes 71 are circular holes. The suction holes 71 penetrate through the sheet feeding belt 70. As shown in FIG. 4, the sheet feeding belt 70 is an endless belt. The sheet feeding belt 70 is wound around the drive roller 72 and the plurality of driven rollers 73. The belt motor 74 (see FIG. 5) rotates the drive roller 72. The rotation of the belt motor 74 makes the sheet feeding belt 70 rotate.

The sheet feeding belt 70 is arranged such that the center of the sheet feeding belt 70 in the main scanning direction (which is perpendicular to the sheet conveyance direction) and the centers of the sheets regulated by the width regulation cursors 53 in the main scanning direction coincide with each other. The width of the sheet feeding belt 70 in the main scanning direction is designed, for example, to be equal to the width of a sheet of the minimum printable size. A bottom face of the sheet feeding belt 70 is horizontal.

Figure 4:
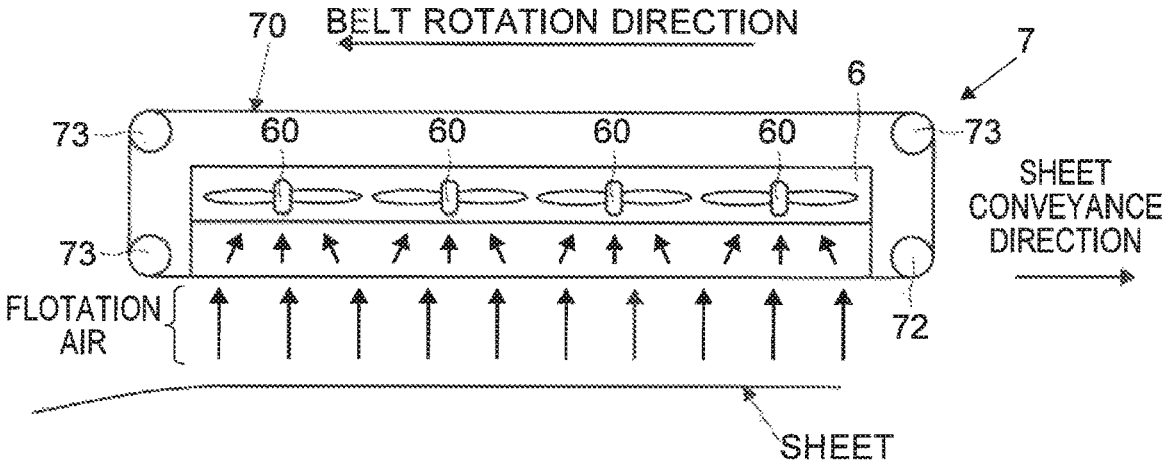
FIG. 4 is a diagram showing an example of a suction device and of a feeding out mechanism according to the embodiment.
Figure 5:
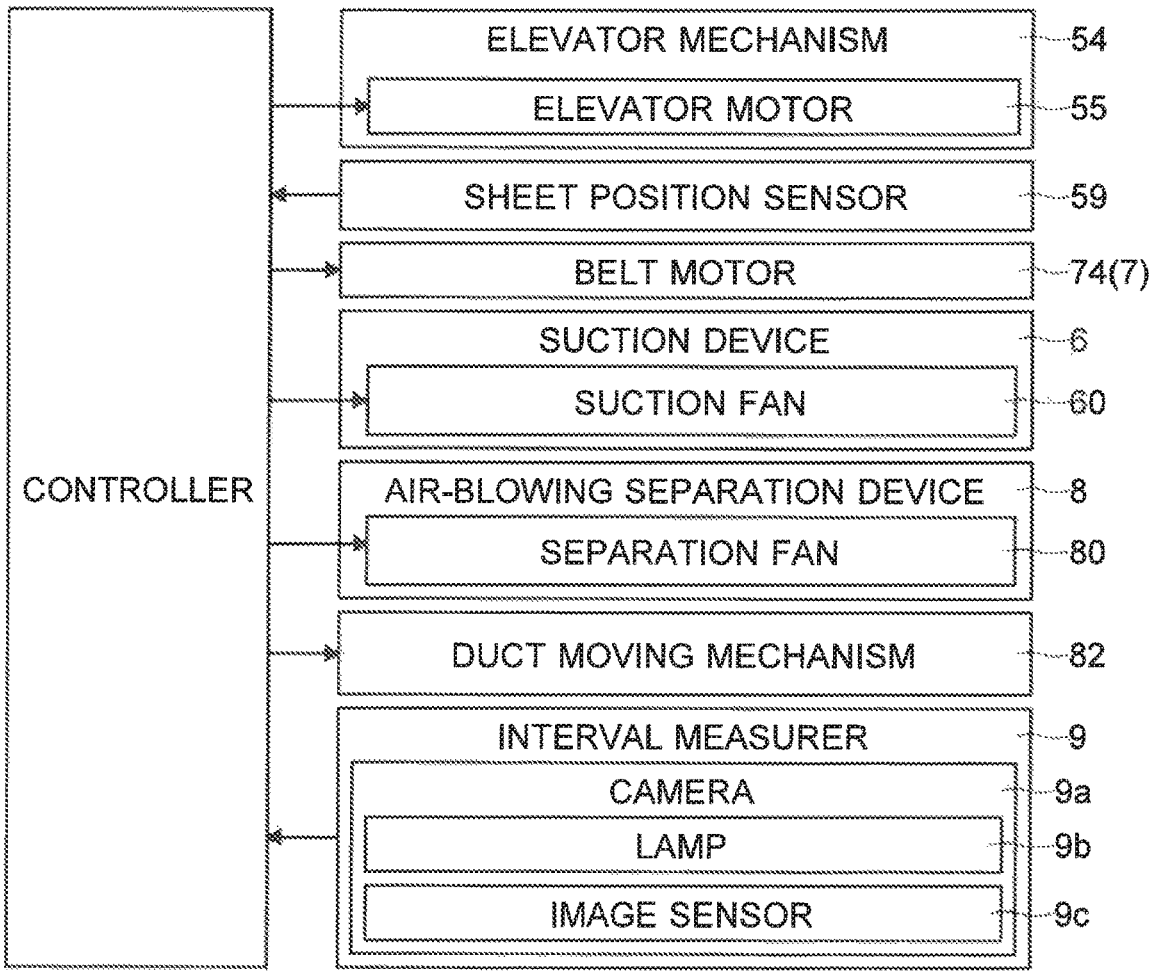
FIG. 5 is a diagram showing an example of a sheet feeder according to the embodiment.

The left-right direction in FIG. 4 is the sub scanning direction (the sheet conveyance direction). Inside the wound sheet feeding belt 70, the suction device 6 (suction fan 60) is provided. The suction device 6 sucks in air through such ones of the suction holes 71 as are formed in the bottom face of the sheet feeding belt 70. The suction device 6 sucks in air existing below the sheet feeding belt 70. That is, air is sucked in through such ones of the suction holes 71 as are provided in the bottom face of the sheet feeding belt 70. A flow of air generated by this suction functions as the flotation air. The thus generated flotation air floats a top sheet of the stack of sheets. By the flotation air (suction by the suction device 6), the top sheet is attracted (drawn) by suction to the sheet feeding belt 70. Here, the flotation air also makes a second sheet from the top (the sheet immediately below the top sheet, a second sheet) float up to some extent.

The suction device 6 is provided with a suction fan 60 or a plurality of suction fans 60. FIG. 4 shows an example where a plurality of suction fans 60 are provided. The suction fans 60 rotate in a direction for sucking in air existing below the sheet feeding belt 70. By the rotation of the suction fans 60, the top sheet located below the sheet feeding belt 70 is attracted by suction together with air. By the suction, the floating top sheet comes into contact with the sheet feeding belt 70.

With the sheet adhering to the sheet feeding belt 70, the controller 1 rotates the belt motor 74. The controller 1 rotates the sheet feeding belt 70 in a direction for feeding out the sheet in the sheet conveyance direction (toward the sheet conveyer 4*b*). The fed-out sheet enters the conveyance roller pairs of the sheet conveyer 4*b*. Thereafter, the controller 1 makes the sheet conveyer 4*b* convey the sheet toward the image former 4*c* and the fixer 4*d*.

Next, with reference to FIG. 3 and FIG. 5, an example of the air-blowing separation device 8 will be described. The air-blowing separation device 8 generates separation air. When sheet feeding is performed (when the suction fans 60 attracts the sheet by suction), the controller 1 makes the air-blowing separation device 8 (a separation fan 80) generate separation air. The separation air is air that is blown to a side face of the set stack of sheets. The air-blowing separation device 8 blows the separation air to such ones of the edges of the sheets as are parallel to the sheet conveyance direction (the sub scanning direction).

The separation air has a function of forming a gap between sheets. The separation air is air for eliminating contact between a sheet (a top sheet) attracted by suction to adhere to the sheet feeding belt 70 and the second sheet from the top (the second sheet). That is, the separation air flows into between the top and second sheets. The separation air helps reduce friction between the top and second sheets. This helps reduce the occurrence of conveyance of a plurality of sheets sticking together (multi-feeding). The separation air also helps prevent a plurality of sheets from being attracted together by suction to adhere to the sheet feeding belt 70. The separation air is also effective to separate tightly contacting sheets from each other.

The air-blowing separation device 8 includes the separation fan 80 and blowing ducts 81. The separation fan 80 generates the separation air. The controller 1 rotates the separation fan 80 so that air is blown out through the blowing ducts 81. The blowing ducts 81 blow out the separation air. The blowing ducts 81 blow out the separation air to the lateral sides (the sides parallel to the sub scanning direction) of the stack of sheets. The blowing ducts 81 blow out air toward, for example, a sheet located at the height of the specified position.

The position of an end of a sheet in the main scanning direction (which is perpendicular to the sheet conveyance direction) depends on the size of the sheet. With consideration give to this, the blowing ducts 81 are designed such that their positions are variable in the main scanning direction. For example, the operation panel 3 accepts a setting of the size of the set sheets. The sheet feeding cassette 5 (the sheet feeder) is provided with a duct moving mechanism 82 which moves the positions of the blowing ducts 81. The controller 1 makes the duct moving mechanism 82 move the positions of the blowing ducts 81 in accordance with the size of the set sheets. The controller 1 automatically adjusts the positions of the blowing ducts 81 in accordance with the size of the set sheets. The duct moving mechanism 82 may be designed such that the positions of the blowing ducts 81 are manually changeable.

The sheet feeding cassette 5 (the sheet feeder) is provided with an interval measurer 9. The interval measurer 9 measures a sheet-to-sheet interval in the up-down direction (the height direction) when the suction device 6 (the suction fan 60) is attracting a sheet by suction. Based on the output of the interval measurer 9, the controller 1 recognizes the sheet-to-sheet interval.

Figure 6:
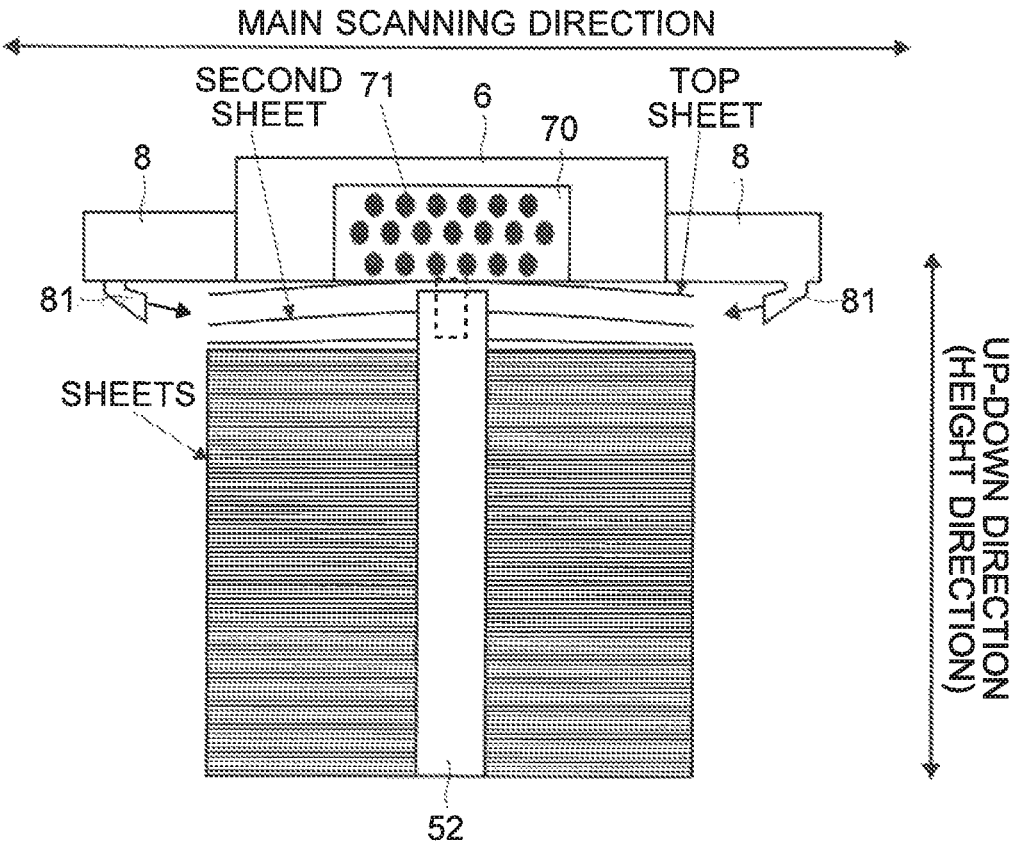
FIG. 6 is a diagram showing an example of measurement performed by an interval measurer according to the embodiment.

Measurement by Interval Measurer 9:

Next, with reference to FIG. 6, a description will be given of an example of measurement performed by the interval measurer 9 according to the embodiment. FIG. 6 is a diagram showing an example of the state (the behavior) of the sheets when a top sheet is being attracted by suction to the sheet feeding belt 70. With the flotation air, the sheet feeding belt 70 attracts the top sheet by suction to make the top sheet adhere thereto. By the effect of the separation air, a void layer (a space, a gap) is formed between the top and second sheets. The interval measurer 9 is a sensor that measures the dimension of the void layer in the height direction (the up-down direction).

Here, there is a case where the width of a sheet in the main scanning direction (which is perpendicular to the sheet conveyance direction) is wider than the width of the sheet feeding belt 70 in the main scanning direction. In such a case, such parts of the sheet as are away from the sheet feeding belt 70 (that is, end parts of the sheet in the main scanning direction) slightly droop. That is, the end parts of the sheet in the main scanning direction are located below the center part of the sheet in the main scanning direction. When being attracted by suction, the sheet floats in an upward convex shape. FIG. 6 also shows a state where a sheet is floating in an upward convex shape.

The interval measurer 9 includes a camera 9*a*. The camera 9*a* includes a lamp 9*b* and an image sensor 9*c*. For example, the image sensor 9*c* is an area image sensor (a two-dimensional image sensor). The camera 9*a* is provided on the rear edge regulation cursor 52. When the suction device 6 is generating the flotation air and the air-blowing separation device 8 is generating the separation air, the controller 1 makes the interval measurer 9 (the camera 9*a*) perform image shooting. Specifically, the controller 1 turns on the lamp 9*b*. While the lamp 9*b* is on, the controller 1 makes the image sensor 9*c* perform reading.

The shooting direction of the camera 9*a* is a direction toward an downstream side in the sheet conveyance direction as seen from the regulation cursor 52. The camera 9*a* shoots an image of sheets from the side of the rear edges of the sheets. The camera 9*a* is positioned such that its shooting range satisfies the following conditions. For example, a first condition is that the bottom face of the sheet feeding belt 70 should be included in the shooting range. A second condition is that top and second sheets are included in the shooting range while the flotation air and the separating are being generated. A third condition is that the center of the shooting range in the main scanning direction (which is perpendicular to the sheet conveyance direction) coincides with the main-scanning-direction centers of the set stack of sheets. In FIG. 6, an example of the shooting range of the camera 9*a* (the interval measurer 9) is indicated by the short-dashed-line rectangle.

The Interval measurer 9 measures a sheet-to-sheet interval when the suction fan 60 is attracting a sheet by suction. The image sensor 9*c* of the interval measurer 9 outputs an analogue image signal obtained by shooting. The analogue image signal is fed to the controller 1. Based on the received analogue image signal, the controller 1 (the image processing circuit 11) generates a shot image data. The controller 1 processes the shot image data, and recognizes the interval (the sheet-to-sheet interval) in the height direction (the up-down direction) between the top and second sheets. Based on the output of the interval measurer 9, the controller 1 recognizes the sheet-to-sheet interval.

Such part of the shot image data as corresponds to an image of a sheet has pixel values of, for example, a bright color (for example, white). Such part of the shot image data as corresponds to a gap between sheets has pixel values of, for example, a dark color (for example, black). For example, the controller 1 (the image processing circuit 11) performs binarization processing on the shot image data. The controller 1 performs edge emphasis processing on the binarized image data. Thereby, the controller 1 detects lines (curved or straight lines) that indicate the rear edges of sheets.

The controller 1 (the image processing circuit 11) recognizes, among the lines indicating the sheets, the line at the top (the line indicating the top sheet) and the second line from the top (the line indicating the second sheet). Then, the controller 1 calculates the interval between the lines indicating the top and second sheets in the up-down direction. For example, the controller 1, with respect to each line parallel to the up-down direction, finds the interval between a pixel indicating the top sheet and a pixel indicating the second sheet. The controller 1 calculates, as the sheet-to-sheet interval, the average value, the maximum value, the minimum value, or the median of the thus found intervals.

The interval measurer 9 measures, as the sheet-to-sheet interval, a gap between a top sheet and a second sheet (which is Immediately under the top sheet) of the sheets set on the sheet setting plate 51. Based on the output of the interval measurer 9, the controller 1 recognizes the sheet-to-sheet interval between the top and second sheets.

Figure 7:
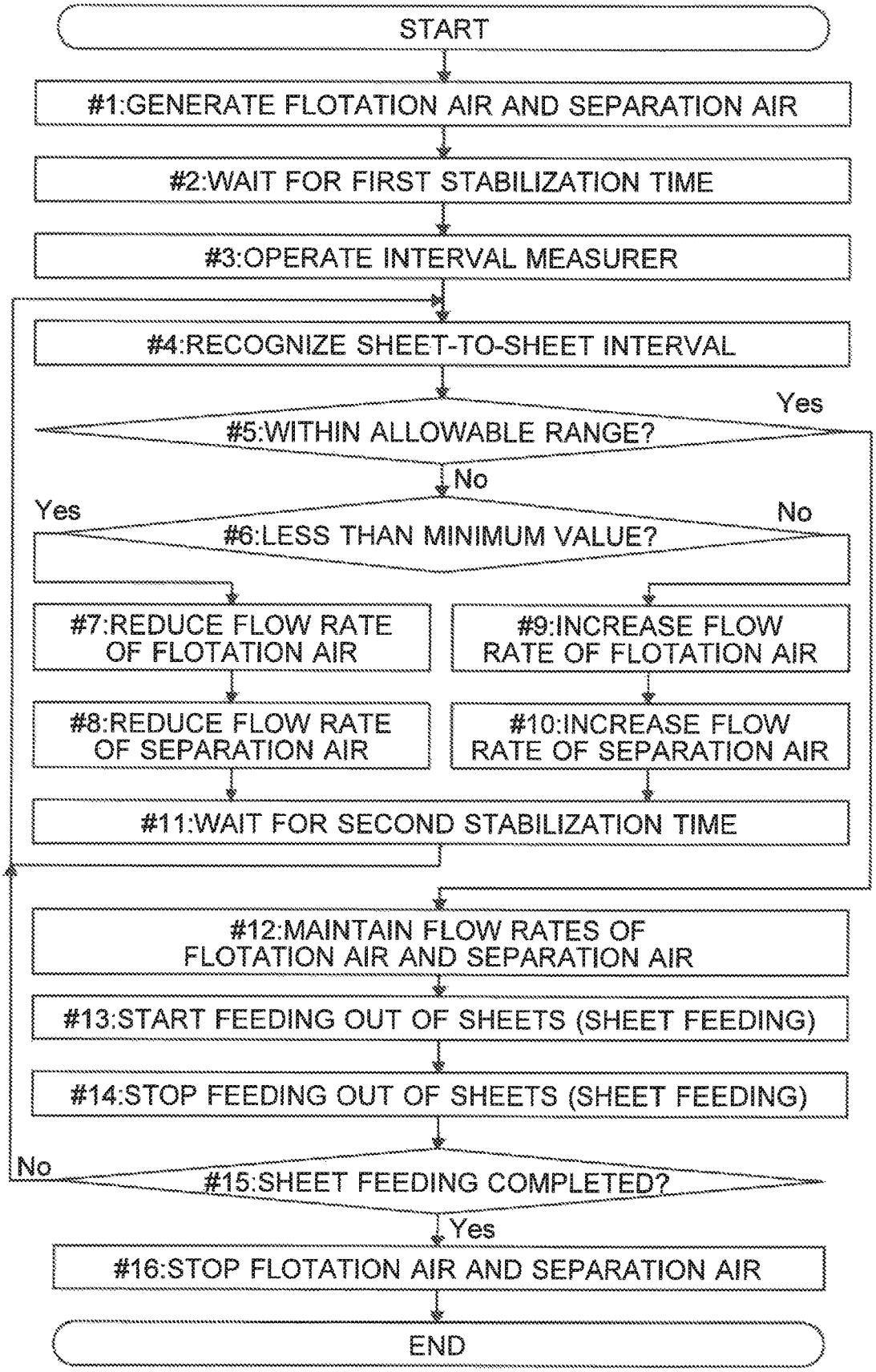
FIG. 7 is a diagram showing an example of a flow of controlling a flow rate of flotation air and of separation air in the printer according to the embodiment.

Control to Adjust Flow Rate:

Next, with reference to FIG. 7, a description will be given of a flow of control to adjust flow rate of the flotation air and of the separation air performed in the printer 100 according to the embodiment. "Start" in FIG. 7 is a time point at which feeding of the first sheet in a print job is started. First, the controller 1 generates the flotation air and the separation air (step #1). Specifically, the controller 1 starts to rotate the suction fans 60 and the separation fan 80. Then, the controller 1 increases rotation speed of the suction fans 60 and of the separation fan 80. Then, the controller 1 stabilizes the rotation speed of the suction fans 60 (the motors of the suctions fans 60) at a first stable speed. The controller 1 also stabilizes the rotation speed of the separation fan 80 (the motor of the separation fan 80) at a second stable speed.

The first stable speed may be a fixed value. In this case, the first stable speed is a rotation speed of the suction fans 60 (the motors of the suction fans 60) at which the sheet-to-sheet interval is appropriate when sheets (standard sheets) used as a reference are used. Or, the first stable speed may be a rotation speed of the suction fans 60 of the time when a sheet was fed for the printing of the last page in the previous print job. In this case, the controller 1 stores, in the storage medium 2, the rotation speed of the suction fans 60 of the time when a sheet is fed for the printing of the last page in a print job.

The second stable speed may also be a fixed value. In this case, the second stable speed can be a rotation speed of the separation fan 80 (the motor of the separation fan 80) at which the sheet-to-sheet interval is appropriate when sheets (standard sheets) used as a reference are used. Or, the second stable speed may be a rotation speed of the separation fan 80 of the time when a sheet was fed for the printing of the last page in the previous print job. In this case, the controller 1 stores, in the storage medium 2, the rotation speed of the separation fan 80 of the time when a sheet is fed for the printing of the last page in a print job.

For the stabilization of the rotation speed of each fan, the controller 1 waits for a predetermined first stabilization time (step #2). Meanwhile, a top sheet floats, and the sheet feeding belt 70 attracts the top sheet by suction. The first stabilization time is a waiting time until the flow rates of the suction fans 60 and the separation fan 80 become stable. For example, the first stabilization time is about 10 seconds.

Next, the controller 1 operates the interval measurer 9 (step #3). Then, based on the output of the interval measurer 9, the controller 1 recognizes the sheet-to-sheet interval (step #4). Specifically, the controller 1 recognizes the interval between the top sheet (the sheet contacting the sheet feeding belt 70) and the second sheet (the sheet immediately below the top sheet) in the up-down direction.

Next, the controller 1 checks whether or not the recognized sheet-to-sheet interval is within an allowable range B1 (step #5). When the sheet-to-sheet interval is found to be equal to or more than a minimum value but equal to or less than a maximum value of the allowable range B1, the controller 1 judges that the sheet-to-sheet interval is within the allowable range B1. Here, the allowable range B1 is determined in advance. The minimum and maximum values of the allowable range B1 are determined in advance. For example, through an experiment, an appropriate sheet-to-sheet interval range is determined in which neither multi-feeding nor non-feeding occurs. That is, sheet-to-sheet intervals that are unlikely to cause trouble are determined in advance. The storage medium 2 stores therein, in a non-volatile manner, the predetermined allowable range B1 (see FIG. 1).

Here, the operation panel 3 may accept a setting of the allowable range B1. In this case, the user or a maintenance person can determine the allowable range B1. The controller 1 stores, in the storage medium 2, the allowable range B1 set via the operation panel 3. The controller 1 performs the checking using the allowable range B1 stored in the storage medium 2.

When the recognized sheet-to-sheet interval is not within the allowable range B1 (No at step #5), the controller 1 checks whether or not the recognized sheet-to-sheet interval is less than the minimum value of the allowable range B1 (step #6). In a case where the recognized sheet-to-sheet interval is less than the minimum value of the allowable range B1, it can be said that the sheet-to-sheet interval is too short. The second sheet can be regarded as floating excessively. It can be thought that the excessive floating is caused by an excessive flow rate of the flotation air. Also, there is a possibility that the separation air that is stronger than is expected is attracting the second sheet upward.

Reversely, in a case where the recognized sheet-to-sheet interval is more than the maximum value of the allowable range B1, it can be said that the sheet-to-sheet interval is too long. The top and second sheets are too far away from each other. This increases the likeliness of occurrence of non-feeding in the feeding of the next sheet. A possible factor causing insufficient floating of the second sheet is that the flotation air is weaker than it should be. It is also possible that the separation air is weaker than it should be.

Thus, when the recognized sheet-to-sheet interval is less than the minimum value of the allowable range B1 (Yes in step #6), the controller 1 makes the suction device 6 reduce the flow rate of the flotation air (step #7). Specifically, the controller 1 makes the suction device 6 reduce the rotation speed of the suction fans 60 (the motors of the suction fans 60). The controller 1 may be configured to reduce the rotation speed of the suction fans 60 more as the sheet-to-sheet interval is shorter. Here, the controller 1 may be configured not to change (that is, to maintain) the flow rate of the flotation air even when the recognized sheet-to-sheet interval is less than the minimum value of the allowable range B1.

The controller 1 makes the air-blowing separation device 8 reduce the flow rate of the separation air (step #8). Specifically, the controller 1 has the rotation speed of the separation fan 80 (the motor of the separation fan 80) reduced. The controller 1 may be configured to reduce the rotation speed of the separation fan 80 more as the sheet-to-sheet interval is shorter. Here, the controller 1 may be configured not to change (that is, to maintain, not to reduce) the flow rate of the separation fan 80 even when the recognized sheet-to-sheet interval is less than the minimum value of the allowable range B1. The controller 1 may be configured to reduce only one of the flotation air and the separation air.

In contrast, when the recognized sheet-to-sheet interval is more than the maximum value of the allowable range B1 (No in step #6), the controller 1 makes the suction device 6 increase the flow rate of the flotation air (step #9). Specifically, the controller 1 makes the suction device 6 increase the rotation speed of the suction fans 60 (the motors of the suction fans 60). The controller 1 may be configured to increase the rotation speed of the suction fans 60 more as the sheet-to-sheet interval is longer. Here, the controller 1 may be configured not to change (that is, to maintain, not to increase) the flow rate of the flotation air even when the recognized sheet-to-sheet interval is more than the maximum value of the allowable range B1.

The controller 1 makes the air-blowing separation device 8 increase the flow rate of the separation air (step #10). Specifically, the controller 1 has the rotation speed of the separation fan 80 (the motor of the separation fan 80) increased. The controller 1 may be configured to increase the rotation speed of the separation fan 80 more as the sheet-to-sheet interval is longer. Here, the controller 1 may be configured not to change (that is, to maintain, not to increase) the flow rate of the separation fan 80 even when the recognized sheet-to-sheet interval is more than the maximum value of the allowable range B1. The controller 1 may be configured to increase only one of the flotation air and the separation air.

After adjusting the flow rates of the flotation air and the separation air, the controller 1 waits for a predetermined second stabilization time (step #11). The controller 1 stabilizes the adjusted (changed) flow rates. The second stabilization time is a waiting time until the flow rates of the suction fans 60 and the separation fan 80 become stable. The second stabilization time is shorter than the first stabilization time. This is because the suction fans 60 and the separation fan 80 are already rotating and thus the time necessary for the flow rates to become stable is shorter than at the rotation starting time. For example, the second stabilization time is about one to several seconds. Then, the controller 1 executes step #4 (returns to step #4).

When the recognized sheet-to-sheet interval is within the allowable range B1 (Yes in step #5), the controller 1 maintains the flow rates of the flotation air and the separation air (step #12). Specifically, the controller 1 maintains the rotation speeds of the suction fans 60 (the motors of the suction fans 60) and the separation fan 80 (the motor of the separation fan 80). Then, the controller 1 starts the feeding out (sheet feeding) of the sheet that is being attracted by suction (step #13). Specifically, the controller 1 rotates the belt motor 74. Thereby, the sheet that is being attracted by suction to adhere to the sheet feeding belt 70 is fed out toward the sheet conveyer 4*b* and the image former 4*c*.

Shortly, the controller 1 stops the feeding out (sheet feeding) of the sheet the sheet that is being attracted by suction (step #14). Specifically, the controller 1 stops the rotation of the belt motor 74. For example, near the most upstream conveyance roller pair of the sheet conveyer 4*b*, there is provided a sensor that detects arrival of the leading edge of a sheet. Until this sensor detects arrival of the sheet and the most upstream conveyance roller takes over the conveyance of the sheet, the controller 1 continues rotating the belt motor 74.

The controller 1 checks whether or not the feeding of the last sheet (page) has been completed (step #15). When there is still a sheet left to be fed (No in step #15), the controller 1 executes step #4 (returns to step #4). On the other hand, when the feeding of the last sheet is completed, (Yes in step #15), the controller 1 stops the flotation air and the separation air (step #16). Specifically, the controller 1 stops the suction fans 60 and the separation fan 80. Then, the controller 1 finishes the process indicated in the present flowchart (END).

As has been described above, the sheet feeder according to the embodiment includes the sheet setting plate 51, the regulation cursors 52 and 53, the sheet feeding belt 70, the suction fan 60 (the suction device 6), the belt motor 74 (the feeding out mechanism 7), the interval measurer 9, and the controller 1. On the sheet setting plate 51, sheets are set. The regulation cursors 52 and 53 regulate the positions of the set sheets set on the sheet setting plate 51. The sheet feeding belt 70 is provided above the sheet setting plate 51 and the set sheets. The sheet feeding belt 70 is provided with the suction holes 71. The suction fans 60 sucks in air through the sheet feeding belt 70 to generate the flotation air. The suction fans 60 uses the flotation air to attract the set sheets by suction. The belt motor 74 rotates the sheet feeding belt 70 to feed out a sheet. The interval measurer 9 measures the sheet-to-sheet interval when the suction fans 60 is attracting a sheet by suction. Based on the output of the interval measurer 9, the controller 1 recognizes the sheet-to-sheet interval. Based on the recognized sheet-to-sheet interval, the controller 1 adjusts the flow rate of the flotation air.

It is possible to measure the interval (the sheet-to-sheet interval) between a sheet that is being attracted to the sheet feeding belt 70 by suction and another sheet. It can be checked whether or not the two sheets are so close to each other (the sheet-to-sheet interval is so short) that multi-feeding may occur. In other words, it is possible to check whether or not the flotation air is too strong. It is also possible to check whether or not the sheets are so far away from each other that non-feeding may occur. In other words, it is possible to check whether or not the flotation air is too weak. It can be checked, based on the recognized sheet-to-sheet interval, whether or not there is an appropriate interval between the sheet that is being attracted by suction to the sheet feeding belt 70 and the other sheet. Based on the result of the checking, the flow rate of the flotation air can be adjusted for a sheet-to-sheet interval that is unlikely to cause multi-feeding.

When the recognized sheet-to-sheet interval is equal to or more than the minimum value of the predetermined allowable range B1 but equal to or less than the maximum value of the predetermined allowable range B1, the controller 1 makes the suction fans 60 maintain the flow rate of the flotation air. When the recognized sheet-to-sheet interval is less than the minimum value of the allowable range B1, the controller 1 makes the suction fans 60 reduce the flow rate of the flotation air. When the recognized sheet-to-sheet interval is more than the maximum value of the allowable range B1, the controller 1 makes the suction fans 60 increase the flow rate of the flotation air. In a case where the interval between sheets being attracted by suction is too short or too long in the up-down direction, it is possible to adjust the flow rate of the flotation air for an appropriate interval. Adjustment is possible such that the flotation air is neither too strong nor too weak. It is possible to achieve an appropriate strength (flow rate) of the flotation air so that neither multi-feeding nor non-feeding will occur.

The sheet feeder includes the separation fan 80 which generates the separation air, and which blows the separation air to a side face of the set sheets. While the suction fan 60 is attracting a sheet by suction, the controller 1 makes the the separation fan 80 generate the separation air. Based on the recognized sheet-to-sheet interval, the controller 1 adjusts the flow rate of the separation air. It can be checked whether or not the interval (the sheet-to-sheet interval) between a sheet that is being attracted to the sheet feeding belt 70 by suction and another sheet is appropriate. In other words, it is possible to check whether or not the separation air is too strong, and also, whether or not the separation air is too weak. The flow rate of the separation air can be adjusted to prevent multi-feeding.

When the recognized sheet-to-sheet interval is equal to or more than the minimum value of the predetermined allowable range B1 but equal to or less than the maximum value of the predetermined allowable range B1, the controller 1 makes the separation fan 80 maintain the flow rate of the separation air. When the recognized sheet-to-sheet interval is less than the minimum value of the allowable range B1, the controller 1 makes the separation fan 80 reduce the flow rate of the separation air. When the recognized sheet-to-sheet interval is more than the maximum value of the allowable range B1, the controller 1 makes the separation fan 80 increase the flow rate of the separation air. In a case where the sheet-to-sheet interval between sheets that are being attracted by suction is too short or too long in the up-down direction, the flow rate of the separation air can be adjusted for an appropriate sheet-to-sheet interval. In other words, adjustment is possible such that the separation air is neither too strong nor too weak. It is possible to achieve an appropriate strength (flow rate) of the separation air so that neither multi-feeding nor non-feeding will occur.

Based on the output of the interval measurer 9, the controller 1 recognizes, as the sheet-to-sheet interval, the gap between the top sheet and the second sheet, which is the second sheet from the top, of the set sheets. It can be checked whether or not there is an appropriate interval between a sheet that is being attracted by suction into contact with the sheet feeding belt 70 and a sheet immediately below the sheet. Whether or not an error such as multi-feeding will occur can be judged based on the interval between the top sheet and the sheet (the second sheet) immediately below the top sheet.

The sheet feeder includes, as the regulation cursor, the rear edge regulation cursor 52 which regulates the rear edges of the set sheets. The rear edges of the set sheets are their upstream-side edges in the sheet conveyance direction. The interval measurer 9 is a camera 9*a* which is provided on the rear edge regulation cursor 52 and which includes the image sensor 9*c*. The interval measurer 9 can shoot an image showing a state of attraction. It is possible to measure, from the rear edge regulation cursor 52, the sheet-to-sheet interval as seen from the upstream side to the downstream side in the sheet conveyance direction. Based on the measurement, it is possible to judge whether or not an appropriate checking has been performed with respect to the sheets that are being attracted.

Modified Example

Figure 8:
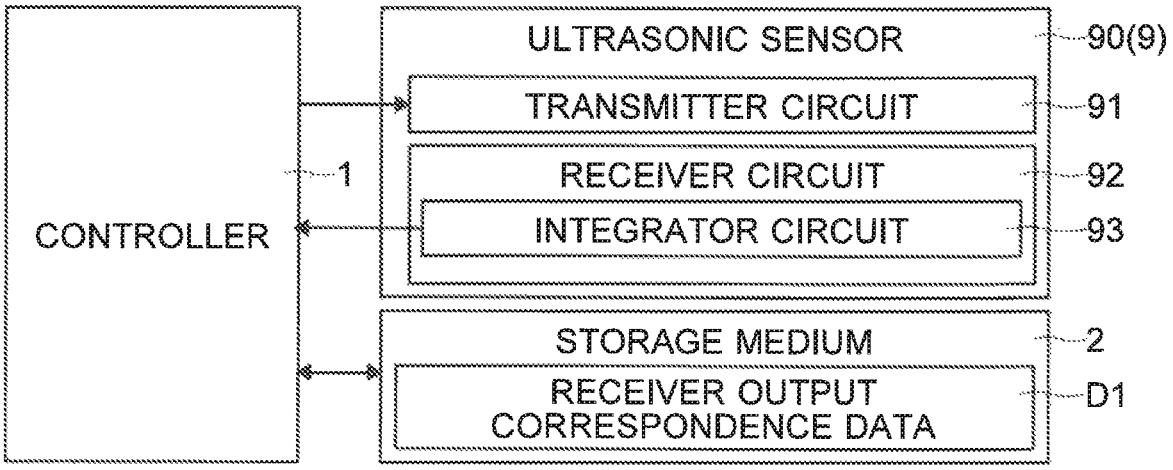
FIG. 8 is a diagram showing an example of an interval measurer according to a modified example.

Next, with reference to FIG. 8 to FIG. 10, a description will be given of a sheet feeder according to a modified example. FIG. 8 is a diagram showing an example of an interval measurer 9 according to the modified example. The description of the embodiment given above has dealt with an example where the interval measurer 9 used therein includes a camera 9*a*. In the modified example, an ultrasonic sensor 90 is used instead of a camera 9*a*. That is, the ultrasonic sensor 90 is included in the interval measurer 9. The modified example is different from the above-described embodiment in that a controller 1 recognizes a sheet-to-sheet interval based on the output of the ultrasonic sensor 90.

The ultrasonic sensor 90 includes a transmitter circuit 91 and a receiver circuit 92. The transmitter circuit 91 and the receiver circuit 92 each include a piezoelectric element. The transmitter circuit 91 transmits ultrasonic waves. A controller 1 feeds a piezoelectric element with a signal (a pulse signal, a detection signal) having a pattern that includes a predetermined number of pulses. The receiver circuit 92 receives the ultrasonic waves transmitted from the transmitter circuit 91. The piezoelectric element of the receiver circuit 92 outputs a voltage in accordance with the strength (level) of the received ultrasonic waves.

The ultrasonic sensor 90 includes an integrator circuit 93. The integrator circuit 93 is charged with (integrates) electric charge outputted from the piezoelectric element of the receiver circuit 92. From the start until the end of the receiving of the ultrasonic waves (the predetermined number of pulses), the controller 1 charges the integrator circuit 93 with the electric charge outputted from the piezoelectric element of the receiver circuit 92. The output of the integrator circuit 93 becomes larger as the sound pressure of the received ultrasonic waves becomes stronger. The controller 1 recognizes the magnitude of the voltage outputted from the receiver circuit 92. Here, before transmission of the predetermined number of ultrasonic waves, the controller 1 makes the integrator circuit 93 discharge the electric charge. The controller 1 controls such that the output value of the integrator circuit 93 is zero at the time point of receiving the first pulse (ultrasonic wave).

The transmitter circuit 91 and the receiver circuit 92 respectively transmits and receives ultrasonic waves. The transmitter circuit 91 and the receiver circuit 92 make the ultrasonic waves pass through a sheet (a top sheet) that is being attracted by suction to a sheet feeding belt 70 and a second sheet. FIG. 9 shows an example of arrangement of the transmitter circuit 91 and the receiver circuit 92. One of the transmitter circuit 91 and the receiver circuit 92 is positioned above the top sheet, and the other one of the transmitter circuit 91 and the receiver circuit 92 is provided outside the sheet feeding belt 70, at a position that is above the bottom face of the sheet feeding belt 70. For example, one of the transmitter circuit 91 and the receiver circuit 92 can be provided outside the sheet feeding belt 70 in the main scanning direction (which is perpendicular to the sheet conveyance direction). And the other one of the transmitter circuit 91 and the receiver circuit 92 can be provided on a rear edge regulation cursor 52. In the following description, whichever of the transmitter circuit 91 and the receiver circuit 92 is provided on the rear edge regulation cursor 52 will be referred to as a cursor sensor 93.

Figure 9:
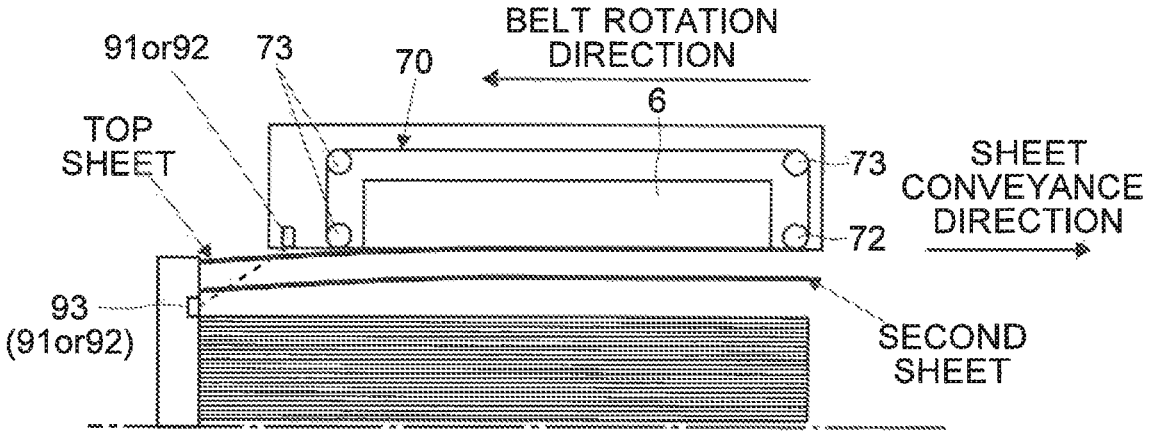
FIG. 9 is a diagram showing an example of a sheet feeder according to the modified example.

FIG. 9 is a diagram showing set sheets and a suction device 6 as seen from the main scanning direction (which is perpendicular to the sheet conveyance direction). As shown in FIG. 9, the transmitter circuit 91 and the receiver circuit 92 make the ultrasonic waves pass through a sheet diagonally with respect to a flat surface of the sheet. Depending on the width of the interval (the sheet-to-sheet interval) between top and second sheets, the strength of the ultrasonic waves that the receiver circuit 92 receives varies. For example, there is a case where the wider the sheet-to-sheet interval is, the lower the strength of the ultrasonic waves received by the receiver circuit 92 becomes. Thus, there is a case where the wider the sheet-to-sheet interval is, the lower the output voltage of the integrator circuit 93 becomes. Reversely, there is a case where the narrower the interval between the top and second sheets is, the higher the output voltage of the integrator circuit 93 becomes.

When the ultrasonic sensor 90 is used as the interval measurer 9, a storage medium 2 stores therein receiver output correspondence data D1 in a non-volatile manner (see FIG. 8). The receiver output correspondence data D1 is data (a table) defining sheet-to-sheet intervals corresponding to different output voltages of the receiver circuit 92. The controller 1 recognizes the magnitude of the output voltage of the receiver circuit 92. The controller 1 refers to the receiver output correspondence data D1, and reads the sheet-to-sheet interval that corresponds to the recognized output voltage of the receiver circuit 92. The controller 1 compares the read sheet-to-sheet interval with the allowable range B1.

Here, the rear edge regulation cursor 52 is slidable parallel to the sheet conveyance direction. As the rear edge regulation cursor 52 moves, the position of the cursor sensor 93 changes in the sub scanning direction (the sheet conveyance direction). And, for accurate measurement of the sheet-to-sheet interval between the top and second sheets, it is preferable for the receiver circuit 92 to receive the ultrasonic waves that have passed through both the top and second sheets. Thus, the rear edge regulation cursor 52 is provided with a movement mechanism 94. The movement mechanism 94 moves the cursor sensor 93 in the up-down direction in accordance with the position of the rear edge regulation cursor 52. The movement mechanism 94 adjusts the position of the cursor sensor 93 such that the ultrasonic waves transmitted can be received after they pass through the top and second sheets.

Figure 10:
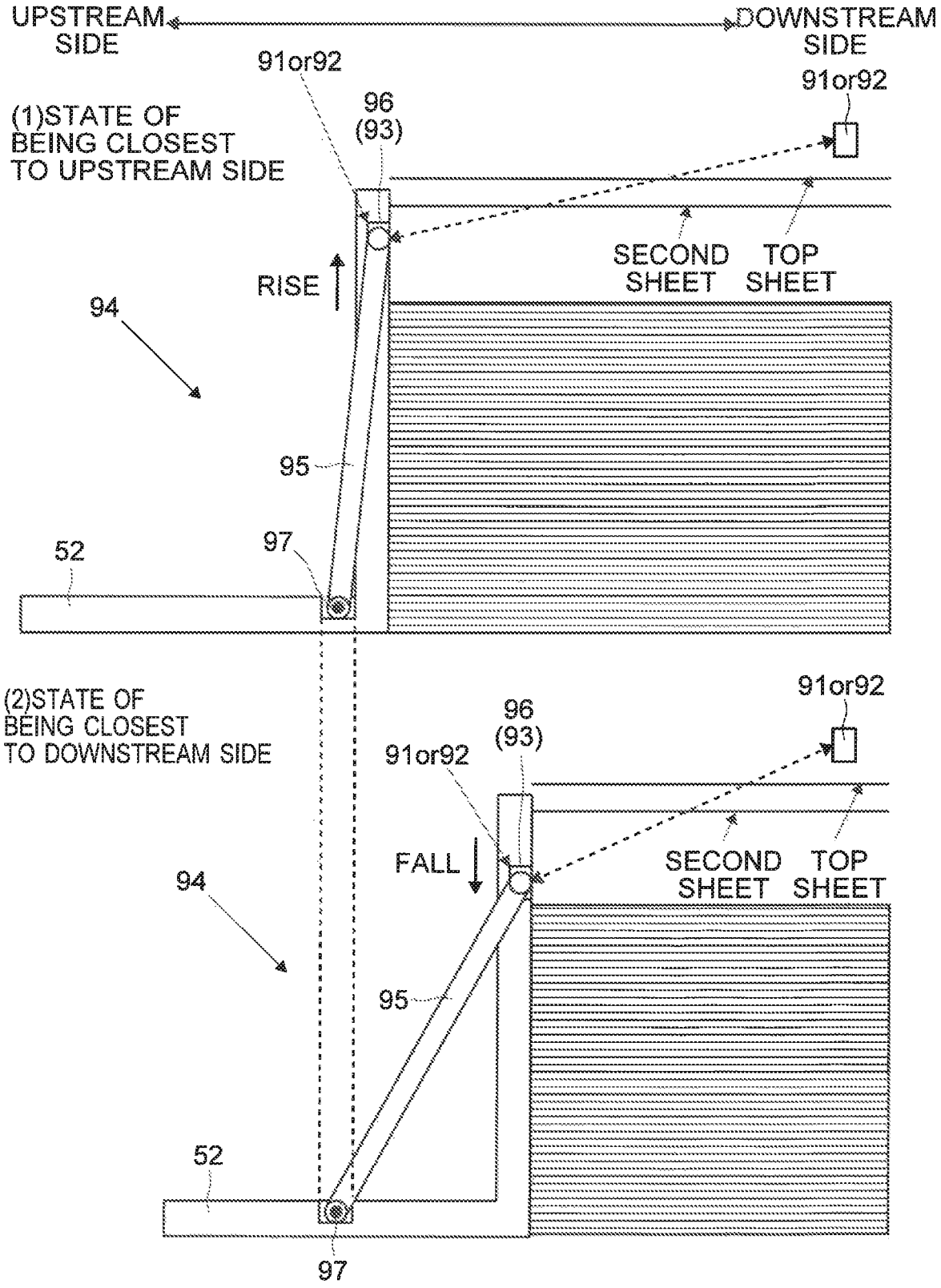
FIG. 10 is a diagram showing the example of the sheet feeder according to the modified example.

As shown in FIG. 10, the more the rear edge regulation cursor 52 moves toward the upstream side in the sheet conveyance direction, the movement mechanism 94 makes the cursor sensor 93 move more upward. In other words, the more the cursor sensor 93 moves toward the downstream side in the sheet conveyance direction, the movement mechanism 94 makes the cursor sensor 93 move more downward. Thus, regardless of the position of the rear edge regulation cursor 52, it possible to make the receiver circuit 92 receive the ultrasonic waves that have passed through only the top and second sheets. It is possible to keep the inclination of a straight line connecting from the transmitter circuit 91 to the receiver circuit 92 within a constant range.

FIG. 10 shows an example of the movement mechanism 94. For example, the movement mechanism 94 is an orthogonal slide mechanism. The movement mechanism 94 is partly or entirely fitted to the rear edge regulation cursor 52. The orthogonal slide mechanism includes a driven link 95, a slide joint 96, and a rotation shaft 97. The rear edge regulation cursor 52 is L-shaped. A lower end of the rear edge regulation cursor 52 is parallel to the sub scanning direction (the sheet conveyance direction). The position of the rotation shaft 97 in the sub scanning direction is fixed (at a lower part of the rear edge regulation cursor 52). To the slide joint 96, the cursor sensor 93 is attached. As the rear edge regulation cursor 52 slides, the driven link 95 rotates (swings). The rotation of the driven link 95 makes the slide joint 96 move in the up-down (vertical) direction.

The sheet feeder according to the modified example includes, as a regulation cursor, the rear edge regulation cursor 52 which regulates the rear edges of the set sheets. The rear edges of the set sheets are the upstream-side edges of the sheet in the sheet conveyance direction. The interval measurer 9 is the ultrasonic sensor 90. The ultrasonic sensor 90 includes the transmitter circuit 91 and the receiver circuit 92. The transmitter circuit 91 transmits ultrasonic waves. The receiver circuit 92 outputs a voltage corresponding to the level of received ultrasonic waves. One of the transmitter circuit 91 and the receiver circuit 92 is provided at a position that is above the lower side of the sheet feeding belt 70. The other one of the transmitter circuit 91 and the receiver circuit 92 is provided on the rear edge regulation cursor 52. The ultrasonic sensor 90 can be used to check whether or not there is an appropriate interval between attracted sheets.

The rear edge regulation cursor 52 is slidable parallel to the sheet conveyance direction. The sheet feeder includes the movement mechanism 94. The movement mechanism 94 vertically moves the cursor sensor 93, which is the transmitter circuit 91 or the receiver circuit 92 provided on the rear edge regulation cursor 52. The more the rear edge regulation cursor 52 moves toward the upstream side in the sheet conveyance direction, the more upward the movement mechanism 94 moves the cursor sensor 93. The more the rear edge regulation cursor 52 moves toward the downstream side in the sheet conveyance direction, the more downward the movement mechanism 94 moves the cursor sensor 93.

The embodiments of the present disclosure described herein are not meant to limit the scope of the present disclosure in any manner. The present disclosure may be implemented by making various modifications thereto without departing from the spirit of the present disclosure.

What is claimed is:

1. A sheet feeder comprising:

a sheet setting plate on which sheets are set;

a regulation cursor which regulates positions of the sheets set on the sheet setting plate;

a sheet feeding belt which is provided above the sheet setting plate and the sheets set on the sheet setting plate, and which is provided with a suction hole;

a suction fan which includes a motor for rotation, and sucks in air through the sheet feeding belt to generate flotation air, and which uses the flotation air to attract by suction the sheets set on the sheet setting plate;

a separation fan which includes a motor for rotation, generates separation air, and blows the separation air to a side of the sheets set on the sheet setting plate;

a belt motor which rotates the sheet feeding belt to feed out a sheet of the sheets set on the sheet setting plate;

an interval measurer which measures a sheet-to-sheet interval when the suction fan is attracting the sheet by suction; and a controller which recognizes the sheet-to-sheet interval based on an output of the interval measurer, and which adjusts a flow rate of the flotation air based on the sheet-to-sheet interval recognized, wherein the controller makes the separation fan generate the separation air when the suction fan is attracting the sheet by suction, makes the separation fan maintain the flow rate of the separation air when the sheet-to-sheet interval recognized is equal to or more than a minimum value of a predetermined allowable range but equal to or less than a maximum value of the allowable range, makes the separation fan reduce the flow rate of the separation air when the sheet-to-sheet interval recognized is less than the minimum value of the allowable range, and makes the separation fan increase the flow rate of the separation air when the sheet-to-sheet interval recognized is more than the maximum value of the allowable range.

2. The sheet feeder according to claim 1, wherein the controller makes the suction fan maintain the flow rate of the flotation air when the sheet-to-sheet interval recognized is equal to or more than a minimum value of a predetermined allowable range but equal to or less than a maximum value of the allowable range, makes the suction fan reduce the flow rate of the flotation air when the sheet-to-sheet interval recognized is less than the minimum value of the allowable range, and makes the suction fan increase the flow rate of the flotation air when the sheet-to-sheet interval recognized is more than the maximum value of the allowable range.

3. The sheet feeder according to claim 1, wherein, based on an output of the interval measurer, the controller recognizes, as the sheet-to-sheet interval, a gap between a top sheet and a second sheet of the sheets set on the sheet setting plate, the second sheet being a sheet that is second from a top of the sheets set on the sheet setting plate.

4. The sheet feeder according to claim 1, wherein the sheet feeder includes, as the regulation cursor, a rear edge regulation cursor which regulates rear edges of the sheets set on the sheet setting plate, the rear edges of the sheets set on the sheet setting plate are upstream-side edges thereof in a sheet conveyance direction, and the interval measurer is a camera and is provided on the rear edge regulation cursor.

5. A sheet feeder comprising:

a sheet setting plate on which sheets are set;

a regulation cursor which regulates positions of the sheets set on the sheet setting plate;

a sheet feeding belt which is provided above the sheet setting plate and the sheets set on the sheet setting plate, and which is provided with a suction hole;

a suction fan which includes a motor for rotation; and sucks in air through the sheet feeding belt to generate flotation air, and which uses the flotation air to attract by suction the sheets set on the sheet setting plate;

a belt motor which rotates the sheet feeding belt to feed out a sheet of the sheets set on the sheet setting plate;

an interval measurer which measures a sheet-to-sheet interval when the suction fan is attracting the sheet by suction; and a controller which recognizes the sheet-to-sheet interval based on an output of the interval measurer, and which adjusts a flow rate of the flotation air based on the sheet-to-sheet interval recognized;

wherein the sheet feeder includes, as the regulation cursor, a rear edge regulation cursor which regulates rear edges of the sheets set on the sheet setting plate, the rear edges of the sheets set on the sheet setting plate are upstream-side edges thereof in a sheet conveyance direction, the interval measurer is an ultrasonic sensor, the ultrasonic sensor includes a transmitter circuit and a receiver circuit, the transmitter circuit transmits an ultrasonic wave, the receiver circuit outputs a voltage in accordance with a level of a received ultrasonic wave, one of the transmitter circuit and the receiver circuit is provided above a bottom face of the sheet feeding belt, and an other one of the transmitter circuit and the receiver circuit is provided on the rear edge regulation cursor.

6. The sheet feeder according to claim 5, wherein the rear edge regulation cursor is slidable parallel to the sheet conveyance direction, the sheet feeder includes a movement mechanism which moves a cursor sensor in an up-down direction, the cursor sensor being whichever of the transmitter circuit and the receiver circuit is provided on the rear edge regulation cursor, the movement mechanism moves the cursor sensor more upward as the rear edge regulation cursor moves more toward an upstream side in the sheet conveyance direction, and the movement mechanism moves the cursor sensor more downward as the rear edge regulation cursor moves more toward a downstream side in the sheet conveyance direction.

7. The sheet feeder according to claim 6, wherein the movement mechanism includes a driven link, a slide joint, and a rotation shaft, the rear edge regulation cursor is L-shaped, a position of the rotation shaft in a sub scanning direction is fixed, the cursor sensor is attached to the slide joint, when the rear edge regulation cursor is made to slide, the driven link rotates, and rotation of the driven link makes the slide joint move in the up-down direction.

* * * * *